United States Patent [19]

Conway et al.

[11] 4,042,453

[45] * Aug. 16, 1977

[54] TUFTED NONWOVEN FIBROUS WEB

[75] Inventors: Bernard W. Conway, Holyoke, Mass.; James Moran, Simsbury, Conn.

[73] Assignee: The Dexter Corporation, Windsor Locks, Conn.

[ * ] Notice: The portion of the term of this patent subsequent to Sept. 10, 1991, has been disclaimed.

[21] Appl. No.: 673,192

[22] Filed: Apr. 2, 1976

Related U.S. Application Data

[63] Continuation-in-part of Ser. No. 489,411, July 17, 1974, Pat. No. 3,960,652, which is a continuation-in-part of Ser. No. 341,699, March 15, 1973, Pat. No. 3,834,983.

[51] Int. Cl.[2] ..... D21F 11/00

[52] U.S. Cl. ..... 162/108; 162/115; 162/116; 162/146; 162/157 R; 162/157 C; 428/92

[58] Field of Search ..... 162/108, 109, 115, 116, 162/146, 157 R, 157 C, 158, 168 R, 203, 207, 208; 428/85, 92

[56] References Cited

U.S. PATENT DOCUMENTS

| | | | |
|---|---|---|---|
| 3,485,706 | 12/1969 | Evans | 162/115 |
| 3,960,652 | 6/1976 | Conway et al. | 162/115 |

FOREIGN PATENT DOCUMENTS

| | | | |
|---|---|---|---|
| 475,819 | 11/1937 | United Kingdom | 162/109 |

*Primary Examiner*—S. Leon Bashore
*Assistant Examiner*—William F. Smith
*Attorney, Agent, or Firm*—Prutzman, Hayes, Kalb & Chilton

[57] ABSTRACT

A tufted nonwoven web material exhibiting high loft, bulk and absorbency is made by a papermaking technique using an apertured, plate-like, fiber collecting element having a structure appropriate to preventing entanglement between adjacent tufts prior to removal from the element. The tufted nonwoven fibrous web exhibits inwardly turned, spirally consolidated and entangled individual tuft head portions and substantially aligned and untwisted root portions interconnecting the head portion to the undisturbed planar main body of the web material.

7 Claims, 5 Drawing Figures

TUFTED NONWOVEN FIBROUS WEB

RELATED APPLICATION

This is a continuation-in-part of our copending application, Ser. No. 489,411, filed July 17, 1974 now U.S. Pat. No. 3,960,652 which, in turn, is a continuation-in-part of U.S. Pat. No. 3,834,983 based on an application Ser. No. 341,699 filed Mar. 15, 1973.

BACKGROUND OF SUMMARY OF THE INVENTION

The present invention relates generally to tufted nonwoven fibrous web materials. More particularly, it is concerned with new and improved tufted webs made by wet papermaking techniques and exhibiting the appearance and characteristics of high loft absorbent bath toweling and the like.

As is well known, convention wet papermaking techniques have traditionally produced compact, closely formed sheets exhibiting the rattle and smooth surface characteristic usually associated with paper. In recent years, increased emphasis has been placed on the production of nonwoven fabrics for apparel, household and industrial uses. Such fabrics, though initially produced as dry fibrous batts processed on textile carding equipment, now include certain wet-laid webs made on papermaking machines using techniques especially developed for the production of nonwoven materials. The materials thus produced exhibit textile-like characteristics including softness, drape and hand, and have found extensive use in the field of disposable fabrics.

Many of the nonwoven fabrics produced heretofore have utilized a patterned configuration of one form or another in order to impart to the material the desirable characteristics of woven cloth. This patterned configuration has generally been achieved by subjecting a preformed web to controlled destructive forces which rearrange and reorient the fiber construction and provide a multitude of small apertures which improve the drape characteristics of the resultant nonwoven material. Typical examples of this fiber rearranging technique can be found in U.S. Pat. Nos. 2,862,251; 3,042,576; 3,081,515 and 3,485,706.

Another technique for imparting some of the characteristics of woven fabrics to nonwoven fibrous materials is the use of a needle punch operation that forms "pegs" of fibers which increase the structural integrity of the web while improving the flexibility and hand thereof. Still other techniques involve light surface brushing to provide a raised nappy surface exhibiting improved softness, as for example in U.S. Pat. No. 3,101,520, or the use of electrostatic fiber flocking to achieve a comparable nappy surface. A further technique involves the utilization of a crepe or loop-forming operation either alone or in combination with a needle punch. The nonwoven fabrics containing the looped fibers tend to imitate the looped configuration characteristics of woven terry cloth and reportedly exhibit improved softness and high loft.

In substantially all of the foregoing processes it is necessary to first form a web and then subject it to an additional structure altering treatment to provide the desired characteristics. Additionally, in many instances the initial nonwoven web materials are not produced in accordance with the more economical wet papermaking technique, thereby further adding to the cost of the finished product. Some progress has been made in producing patterned webs using a wet papermaking process and mention can be made of the dual wire technique disclosed in U.S. Pat. No. 3,322,617 and the techniques found in U.S. Pat. No. 2,940,891.

Despite these previous attempts, it was found that wet papermaking techniques had not been used successfully to produce tufted nonwoven toweling products having the loft, softness, bulk, absorbency and drape characteristics of turkish toweling. A key factor in the inability of the prior art techniques to produce such materials has been the inability of the wet process to provide high loft materials having a high concentration of absorbent relatively loose and flexible yet sturdy fibers extending outwardly from the main body of the web. However, a major step in that direction is described in our U.S. Pat. No. 3,834,983 issued Sept. 10, 1974 and entitled "Process of Forming Wet Laid Tufted Nonwoven Fibrous Web From a Viscous Fibrous Dispersion and Product". Described therein is a technique that provides tuft formation as the web is being formed. This is achieved using a viscous dispersing medium for the fibers and a coarse web forming wire screen. Although good tuft formation is obtained when using a screen of the type described, sme entanglement of the free ends of adjacent tufts prior to removal of the web from the screen has been experienced. Such entanglement not only adversely affects the appearance of the product but also causes difficulty in removing the web from the web forming wire. These entanglement problems have been overcome by using the apertured plate described in our copending application Ser. No. 489,411, filed July 17, 1974.

Accordingly, it is an object of the present invention to provide an improvement in the product described in our aforementioned patent and more specifically to provide an improved high loft, tufty or tufted nonwoven fibrous web material exhibiting the softness, drape, hand, feel, bulk and absorbency associated with woven looped materials such as turkish or terry toweling.

Another object of the present invention is to provide a new and improved product which uniquely combines the advantageous features of the wet papermaking technology by having on at least one surface thereof a multiplicity of fiber tufts or bundles extending outwardly from the continuous planar body portion of the product in the form of multiple strand fiber bundles exhibiting the appearance of a serried or spirally consolidated fiber bundle or cluster that is twisted back on itself similar to a French knot Still another object of the present invention is to provide a technique and product of the type described wherein tufts are simultaneously formed on both sides of the web material during web formation.

Other objects will be in part obvious and in part pointed out in more detail hereinafter.

These and related objects are accomplished in accordance with the present invention by providing a fibrous nonwoven water-laid web material exhibiting high loft, bulk and absorbency. The web is comprised of a substantially planar web body portion of randomly arranged water dispersable fibers and a multitude of separate, spaced fiber tufts of high concentration arrayed on at least one surface thereof. The tufts are composed of a plurality of closely associated, relatively independent fibers having one end anchored within the web body portion and extending from the web body portion in the form of compressively resilient, spring-like fiber bundles exhibiting a twisted consolidated and serried configuration. The fibers within the tufts have free ends that are anchored within the body but are twisted back on themselves in an intorted spiraled involution that imparts a nubby character to the surface yet retains the desired resiliency and loft.

A better understanding of the objects, advantages, features, properties and relationships of the invention will be obtained from the following detailed description and accompanying drawings which set forth an illustrative embodiment and are indicative of the way in which the principles of the invention are employed.

DESCRIPTION OF A PREFERRED EMBODIMENT

The new and improved tufted nonwoven web materials of the present invention are produced in accordance with the papermaking operation disclosed in our copending application Ser. No. 489,411, filed July 17, 1974 and the disclosure therein is incorporated herein by reference. Use of this technique results in a nonwoven material having a high concentration of separate fiber bundles that take the form of serried tufts located on at least one and preferably both planar surfaces of the web material. Such a tufted material perhaps can be better visualized by first appreciating the structural configuration of both woven toweling and nonwoven looped and nappy web materials.

Turkish or terry toweling is a loosely woven fabric characterized by a nap comprised of a large number of individual loops of thread projecting outwardly from and re-entering the body of the fabric. These individual loops provide a pliable or yieldable cushion and readily bend or distort during use not only to give the soft feel of high bulk or loft, but also to expose greater thread surface area to the desired task of absorbing and wiping.

Nonwoven high loft materials of looped construction are somewhat similar to their woven counterpart but usually have a flexible adhesive base with fibers individually looped outwardly from and re-entering the base and adhesively embedded in the base at both ends of the loop. The nonwoven fabric of this type can be formed by first producing a striated base web of substantially aligned fibers having a fiber length of about 2–3 inches. The web, produced by dry forming techniques, is then imprinted with a lattice-like pattern of adhesive and tensioned to retain the aligned fiber array. The adhesive is cured and the fibers in the web are looped by feeding the web to a gathering blade. In another method high energy liquid streams consolidate a carded web to entangle the fibers into a re-entrant loop configuration with both ends of the loops locked into the body of the web.

Heretofore improved softness has been imparted to textile fabrics by lightly brushing its surface to raise a fibrous nap or pile of individual fibers. This technique has also been applied to nonwoven web material but frequently has resulted in a substantial strength loss and a tendency of the fibers to fall out. It has been reported that suitable bonding will retain the strength of the material while permitting the brushed fibers to individually extend outwardly from the main body of the material to provide the desired softness.

Figure 1:
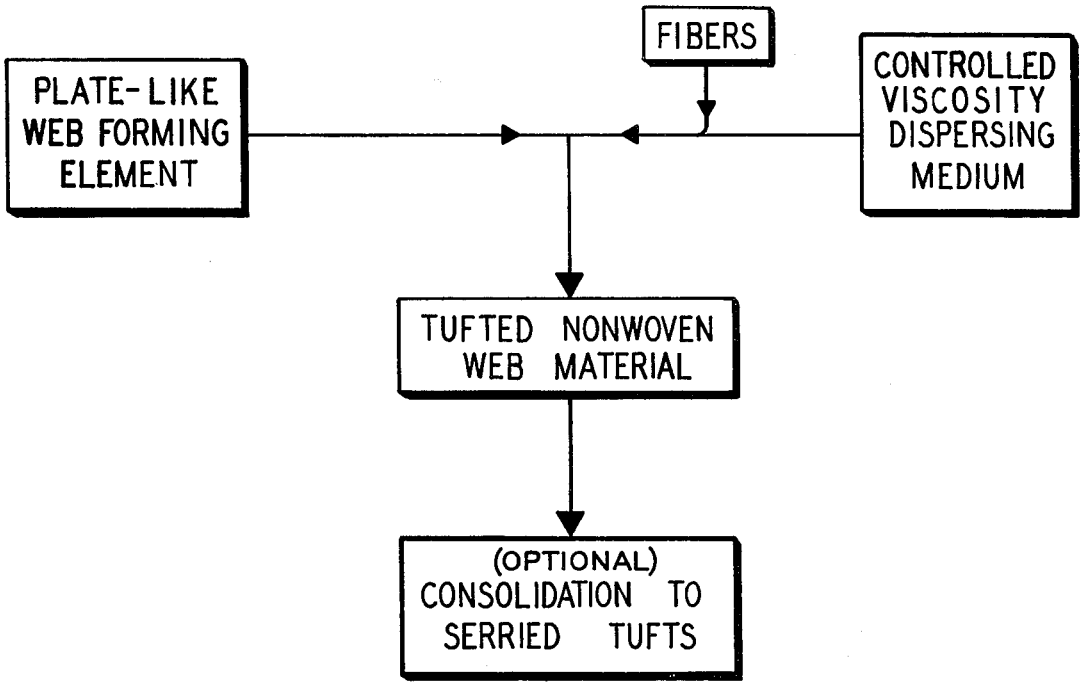
FIG. 1 is a flow diagram of the general steps employed in producing the new and improved web material of the present invention.
Figure 4:
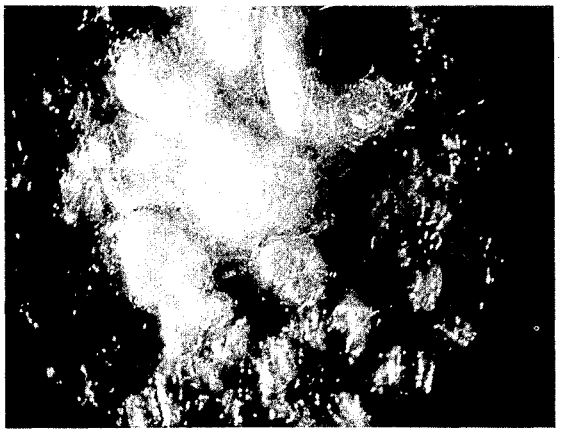
FIG. 4 is a photograph of the surface of the web material of the present invention at a magnification of 5x.

The tufted nonwoven high loft material of the present invention has neither a looped nor brushed or nappy surface, as formed. Instead, as shown in FIG. 4, it is characterized by a large number and high concentration of separate fiber bundles or tufts that extend outwardly from the main fibrous body portion of the web and cover the entire planar surfaces thereof. The multiple fibers in each tuft terminate in free fiber ends initially spaced at randomly different distances from the main fibrous body. Despite the random location of the free fiber ends, the tufts as initially formed exhibit a somehat tapered appearance much like a weft of hair in that they are firmly attached to the main body portion of the web at one end and taper to their longest length near the center of the projecting fiber bundle. The long bundles, if not compacted, will end to exhibit a waviness along their lengths and will is composed of a plurality of closely collected fibers yet initially each fiber is substantially aligned and relatively independent of other fibers within the bundle. This configuration is retained at the root of each tuft even when consolidated. As a result, the tufs exhibit substantial flexibility, pliability and softness and can bend or distort during use in much the same manner as woven terry cloth. When still on the forming element the fiber bundles exhibit a funnel-like configuration that tends to collapse or become obscure upon removal from the forming element. The tufts are consolidated or serried during manufacture to yield a springy or resilient "puff" configuration that imparts high loft, bulk and absorbency to the web material. Unlike pegs produced from needle punch operations or napped surfaces from brushing operations, the fibers within the tufts are not substantially ruptured or disrupted during tuft formation. Instead, the root portion connecting the puff or entangled tuft head to the body of the web is a closely associated array of relatively independent, substantially aligned fibers. Additionally, the planar portion of the web remains entirely undisturbed. As will be understood from the following description, the number of fibers in each tuft and the concentration of the tufts will vary substantially depending on the operating conditions employed in producing the web material.

The fibers forming the root portion of the tufts receive their projecting orientation during sheet formation by controlling a number of factors associated with the wet papermaking process. However, the principle factor involved in this technique is the production of suitable fluid dynamics within the system at the time the fibers are initially deposited on the fiber collecting structure and formed into the nonwoven web.

While all factors associated with the fluid dynamics of the system are not fully understood due to their complex interrelationships, it is believed that best results are achieved by laminar flow through the paper forming element under controlled fluid drainage conditions. The laminar flow apparently tends to orient the fibers into their initial substantially aligned positions perpendicular to the body of the web without at the same time causing the fibers to pass entirely through the collecting structure. In fact the fibers extending through the apertures of the forming element tend to collect against the sidewalls of each aperture and cling to the element thus promoting laminar flow near the center or axis of each aperture.

Two of the factors considered in our aforementioned earlier patent as essential in achieving the optimum fluid flow conditions required for the tufted nonwoven product were (1) the use of a relatively coarse paper forming element and (2) a controlled fluid viscosity in the fiber dispersion used in forming the nonwoven material. However, as mentioned in our copending application, it has been found that the type, and particularly the configuration and surface structure, of the web forming element is a major factor is effective tuft formation. As will be appreciated, other factors interrelated to the aforementioned will also affect the formation of the desired tufted nonwoven material. These include, inter alia, the consistency or fiber concentration of the dispersion, the vacuum used to effect removal of the dispersing medium, the type and composition of fibers employed as well as their denier and length and the basis weight of the resultant product. In fact, it has been found that the use of an appropriate plate and shorter wood pulp fibers will permit the formation of tufted webs in a system that obviates the need for a viscous dispersing medium.

Thus one of the primary and necessary factors associated with the new and improved technique is the utilization of fiber collecting or paper forming elements which are platelike in character and, for some applications, thicker than those normally used in manufacturing light weight and intermediate weight papers. As is known, the standard Fourdrinier wire mesh screens conventionally employed in papermaking are typically woven fine wire members and have about 60–100 strands per inch in each direction with the strands having a thickness or diameter of about 0.006 inch. The screening elements described in detail in our earlier patent were much coarser woven screens having a mesh size of about 45 mesh or less and preferably about 14 to 24 mesh. Although satisfactory tufting has been achieved with such screens, it was found that the tufts exhibited a tendency to adhere to the underside of the coarser screens and became interentangled with each other and with the coarse screen thereby hindering removal of the tufted web from the forming element. It is believed the curved bottom surfaces of the wires and the weave effect of those wires tended to foster the interentanglement.

As described in our copending application it was found that the individual tufts could be maintained in relative isolation and separation prior to removal from the forming element by the use of a plate-like forming element as contrasted to an element that exhibits a woven effect and permits the wet clinging fibers to wrap around the underside of the element. As can be appreciated, the thickness of the plate will vary depending on factors such as the length of the fibers employed. Plates having a thickness from about 1/32 inch have given good results but plates having a thickness of about ¼ inch or more and preferably about ½ inch are used for most webs. The thicker forming element will tend to retain a major portion of the tufts within the individual apertures of the element and will facilitate consolidation of the tufts. Since only a minor portion, if any, of each tuft extends beyond the underside of such forming elements, there is a reduced tendency to resist removal of the web. As will be appreciated the exact type and size of the forming element utilized will also vary with the hole size and the desired product, as well as the type, denier and length of fiber used in the furnish, the consistency of the furnish and the viscosity of the suspending fluid.

Figure 2:
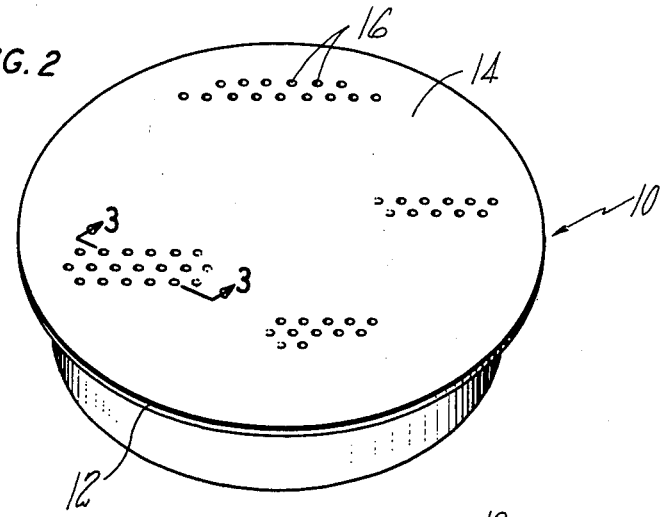
FIG. 2 is a perspective view of a web forming plate for a hand sheet mold used in accordance with the present invention.
Figure 3:
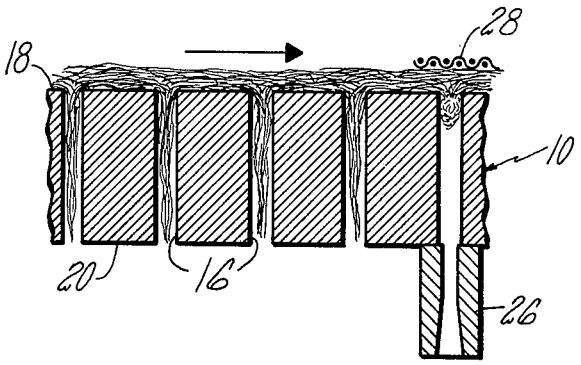
FIG. 3 is an enlarged sectional view of a web forming plate as might be taken along the line 3—3 of FIG. 2 and illustrating the tufted web thereon and a compacting jet and backing screen used in accordance with one aspect of the present invention.

Referring now to FIGS. 2 and 3, a web forming element 10 for a hand sheet mold is shown as one embodiment incorporating the features of the preferred forming plate. The element 10 is a relatively thick plate-like member having a peripheral rim 12 and a web forming control area 14 comprised of a multitude of tuft-forming apertures 16 extending fully through the plate 10 and arranged in a pattern of staggered rows with the distance between the apertures being suited to the particular application. For example, a plate having a thickness of about ½ inch and a central area with a diameter of about 2¾ inches may conveniently accommodate 121 apertures per square inch wherein the apertures have a diameter of 1/16 inch. Such a plate will have an open area of 37.2 percent. The plate 10 exhibits substantially flat and smooth top and bottom surfaces 18 and 20, respectively, within the forming area 14.

It appears that the controlling factors for the plate involve the prevention of tuft entanglement coupled with the maintenance of laminar flow. Thus a thin plate that can provide a "tubular flow effect" through its apertures and at the same time obviate entanglement may be used. Included in this is the forming element's ability to provide an "orifice lip effect" at both the top and bottom surfaces. Thus the smooth top and bottom surfaces of the plate should provide relatively well defined orifice edges or lips at each aperture. A slight degree of curvature is permissible and, in such instances, the lip at the bottom surface appears more critical. The lip effect coupled with the tubular multiapertured configuration permits laminar flow of the dispersing fluid through the plate during web formation so as to drive the fibers into the orientation required for producing the desired tufted configuration. As the fibers flow into these apertures, they tend to cling to the sidewalls of the apertures forming a fiber funnel and promoting the tubular flow. Where the walls of the apertures do not meet the underside of the plate with a large radius curvative, there is less of a tendency to cling to the underside of the element and thus less likelihood of entanglement. The size of the openings in the plate must be controlled so that the fibers within the fiber dispersion will be retained during the web forming processes. Yet at the same time, the size of the solid areas should not be so great as to interfere with the drainage of the fiber dispersion. The precise aperture size and concentration must be such as to provide the required fluid flow during drainage while permitting the requisite fiber collection as the fiber dispersing medium passes rapidly through the apertured plate. Thus in one embodiment the apertures in a 0.5 inch thick plate had a diameter of about 0.063 inch and were arranged in staggered rows, as shown in FIG. 2, on 0.09 inch centers.

The web forming element may be a composite laminar structure but is preferably a plate having 25 and more apertures per square inch and preferably about 100 to 500 apertures per square inch. The apertures may be in a staggered array, as shown, or in other suitable configurations and will vary in size from about 1/32 to about 3/16 inches in diameter.

Generally, the size of the open area will relate to the diameter of the fibers in the dispersion since the thicker fibers form tufts more effectively on the more open plates. For most applications, an average open area between about 15 and 50 percent is preferred although the exact extent of open area as well as the thickness of the plate used can vary substantially depending on the numerous other considerations relating to the papermaking process, particularly the fiber size.

It is an advantage that a nonwoven or woven scrim or gauze or a multitude of continuous filaments may be used in conjunction with the primary fiber collecting element. In that instance the scrim would travel with a supporting element, and the openings in the scrim would facilitate tuft formation while simultaneously embedding the scrim in the nonwoven fibrous web deposited thereon. Such an arrangement would substantially strengthen the web without undue sacrifice in the softness of the tufted material.

Another feature of the papermaking technique involves the use of a dispersing fluid for the fibers that is of controlled viscosity ranging upwardly from that of water, i.e. 1 centipoise, depending on the plate and fibers used in the system. The high viscosity medium advantageously permits the utilization of numerous fibers and mixtures thereof, not heretofore used in a wet papermaking process, including mixtures of textile staple fibers with fibers having a substantially shorter length. The viscous solution used to disperse the fibers prevents the formation of fiber clumps within the dispersion and reduces the tendency of the dispersed fibers to entangle. Additionally, the dispersing medium maintains the fibers in their dispersed condition during drainage and assures a more uniform fiber distribution within the resultant web material thereby contributing to the improved softness, flexibility and drape characteristics of the material produced. As mentioned, the viscous medium substantially expands the number and type of fibers that can be used while the plate permits the use of, at present, aqueous dispersions wherein all of the fibers are very short hard wood fibers. This is believed due primarily to the orifice lip effect and laminar or tubular flow through the plates employed for the short fibers even in the absence of viscosity producing additives in the dispersing medium. Thus the present invention enables tuft formation even upon the utilization of 100 percent natural, or synthetic papermaking or textile staple fibers or appropriate mixtures thereof.

As a general rule, the dispersing medium should exhibit a viscosity greater than about three centipoises when using fibers longer than conventional wood pulp fibers. Although tufting can be achieved at low viscosity levels when other operating characteristics are appropriately controlled and where select fibers are employed, a viscosity of about 10 centipoises or more is preferred for the longer fibers. The viscosity actually utilized will vary and for practical applications can be as low as one centipoise or as high as 250–300 centiposie. As will be appreciated, certain practical considerations will control the upper limit since extremely high viscosities may tend to interfere with the drainage characteristics of the system. Other practical limits relating to the run-ability of the papermaking machine include the vacuum available for removing the dispersing medium without disrupting the web, the concentration of the fibers in the medium, the extractability of the medium and the affect of its residual presence in the web as well as the economics associated with the system.

The viscosity of controlling material may be a natural or synthetic material or blends thereof. However, the preferred viscosity controlling materials are the high molecular weight resins, such as the water soluble polymers formed from the polymerization of acrylamide. These polymers are preferably used since their dilute aqueous solutions can be easily controlled to provide the desired viscosity at the drainage area of the system. The preferred acrylamide polymer employed is a material sold by Dow Chemical Company under the trade name Separan AP-30. Other materials such as polyethylene oxide sold by Union Carbide Corporation under the name Polyox WSR 301 as well as selected viscosity producing carboxy methyl cellulose solutions can be utilized. In addition, other conventionally employed materials that will produce controlled viscosity in aqueous solutions include water soluble synthetic polymeric electrolytes of methacrylic acid and co-polymers thereof, as well as natural viscosity producing materials or mixtures of natural and synthetic gums or inorganic salts. However, in accordance with the preferred embodiment of the invention, the viscosity controlling material should be one that can be added prior to web formation such as in the fiber dispersing equipment, headbox, etc., and will maintain its viscosity up to and through the drainage area of the system.

As mentioned, the particular type of web forming element used and the specific viscosity employed for the dispersing medium will depend on other interrelated factors such as the type, denier and length of the fibers employed in the fiber dispersion. One of the particularly advantageous features of the present invention is the fact that tufted webs can be produced from a wide variety of natural and synthetic papermaking and textile fibers. For example, synthetic or man-made papermaking or textile staple fibers such as rayon, nylon, polyesters or vinyl polymers or co-polymers can be used either along or in combination with natural fibers such as bleached or unbleached Kraft, manila hemp, jute and similar papermaking fibers. Additionally, it is believed that inorganic fibers such as glass, quartz, ceramic, mineral wool, asbestos and similar materials may also be employed in accordance with the teachings of the present invention.

The synthetic fibers may vary in both denier and length although the lower denier fibers are generally preferred. Fibers from about 1 to 1.5 denier per filament (dpf) to about 15 dpf and more have been successfully used and have produced excellent results. However, with the higher denier material it is generally necessary to use a lower fiber concentration and a more viscous dispersing medium. As will be appreciated, the minimum and maximum denier employed will depend on many other related factors including the product requirements, machine operating conditions, consistency, plate size, etc.

The length of the synthetic fibers employed depends to a large degree upon the particular forming element used and will range from about ⅛ of an inch or more up to several inches and can be of the straight cut-tow type used in papermaking operations or the crimped or straight textile staple fiber type. As mentioned, it is preferred to utilize the finer denier material having a length of about ½ to ¾ inch or more in order to impart to the material improved softness while retaining the desired loft and absorbency characteristics. However, mixtures using natural and synthetic papermaking fibers having lengths down to 1/16 inch or less may also be employed depending upon the particular properties and characteristics required in the final product.

In addition to the length and denier of the fibers employed, the fiber consistency or concentration in the dispersion prior to web formation requires appropriate control to facilitate formation of the tufted configuration. As a general rule, the lowest fiber concentration or consistency compatible with good release of the resulting product from the web forming element is most desirable for best tuft formation. Accordingly, a fiber concentration ranging from about 0.01 to about 1.0% can be used, with the preferred range being about 0.05 to 0.5% fiber concentration. In standard laboratory operations a fiber concentration of about 0.2% has been found to produce consistently good results. The consistency on large papermaking machines will, of course, vary with machine conditions.

The fiber concentration and the viscosity of the dispersant will also affect the degree of vacuum or suction that should be applied to the underside of the paper forming element during web formation in order to provide the desired tufted effect. Although good tufting can be obtained under appropriate conditions even in the absence of vacuum, it is generally preferred that a slight vacuum equivalent to about 0.5 inch of mercury be applied to the underside of the web forming wire as the fibers are deposited thereon in order to ensure the appropriate fluid dynamics of the system. In some instances, higher vacuums may be applied such as a vacuum equivalent to a few inches of mercury. However, these variations will depend not only on fiber concentration and the viscosity of the dispersing medium but also on other factors associated with these systems such as the surface smoothness of the forming element and the aperture size and lip configuration as well as the type and length of fiber utilized. Comparable effects may be obtained by applying pressure to the top surface of the web so long as the appropriate pressure differential is created across the web and plate.

An additional factor for consideration when using the technique of the present invention is the weight of the material being produced. The technique described herein is capable of producing a tufted product at weights as low as about ½ ounce per square yard. However, such light weight materials are only produced by very fine control over the other factors associated with the technique and the basis weight of most materials is at least one ounce per square yard or higher.

It can be appreciated the formation of the tufted configuration is initiated at the beginning of the web forming process and in fact it is believed that the tuft is the first portion of the web to be formed as the fibers are draped over the solid portion of the web forming plate and are drawn through the intermediate opening due to the fluid dynamics of the system. As the web gains thickness, more fibers are deposited both in the funnel-like fiber bundles and within the body of the web until it reaches its desired basis weight and strength. It should be noted that the funnel configuration of the initial tuft form dictates the form taken by the root portion of the tuft and is at least partially responsible for its flexibility, pliability and softness as well as its natural cushion effect.

As mentioned, it is a feature of the present invention that the tufts need not be of weft-like appearance but preferably are serried so that the free fiber ends are turned in on themselves in a spiral ball-like involuted and clustered appearance similar to a French knot. Such webs have been found to exhibit up to 100% improvement in tensile strength. This puffy tufted surface is perhaps best shown in the photomicrograph of FIG. 4. In that figure, the tufts are clearly shown as ball-like clusters which have an appearance of obvious softness, pliability, and resiliency.

One way of forming this series tuft configuration is depicted in FIG. 3. In that technique, the tufted web is treated prior to removel from the forming element with a fluid jet of similar consolidating force applied from the bottom of the forming element such as by nozzle 26. A backing wire, such as screen 28 can be placed over the top of the web to prevent undesirable displacement of the web from plate 10. As will be appreciated, the consolidating force is applied to the tufts only, since those portions of the web between the tufts are masked by the plate and remain undisturbed. The force may take the form of a high velocity flow of water or air in the form of a jet stream directed upwardly from below the forming element. The backing screen tends to hold the serried tuft within its individual forming chamber but near the top thereof so that the web can be easily removed from the apertured plate without snagging.

As mentioned hereinbefore, each tuft is firmly anchored within the planar main body portion of the web material and is composed of a plurality of individual fibers that extend in mushroom-like fashion outwardly from the main body portion. One end of these fibers is anchored within the main body portion of the web while a central portion of the fiber bundle extends outwardly from the body portion, circumscribably defining a funnel-like tube base or root configuration resulting from the fluid dynamics of the system. These water-laid fibers assume a natural relaxed undisturbed and unbroken array which extends outwardly from the main body portion at substantially a right angle to the plane thereof. The opposite end of the fibers, that is, the end that is not firmly secured or attached to the main body portion of the web, is initially free and unincorporated into the body of the web so that the tufts, as formed, are completely free of loops and clearly do not re-enter the main body portion of the web to form a loop-like configuration. The funnel-like fiber array at the point of interconnection with the main body portion constitutes the base or root of the individual tuft and retains its unruptured, relatively aligned configuration even after consolidation. This configuration might be viewed as a supporting pedestal or column-like base for the consolidated puffy tuft head of the mushroom configured tuft. However, this base is usually of very short length and may not even appreciably extend out of the main body portion of the web.

As will be appreciated, the free fiber ends of the initially formed but unconsolidated tuft are free to move within the confines of the apertures 16 in the forming plate and, when subjected to the consolidating force, will turn back on themselves in a twisting involution or reverse roll. The consolidating force will spirally sweep the walls of the apertures to loosen the free fiber ends therefrom and twist them inwardly toward the relatively fiber-free axial trough of the funnel-like configuration. Due to the dynamics of the system, the consolidating force applied to the bottom of the forming element tends to enter the apertures 16 with an angular force component and to therefore effect consolidation in a spiraling fashion as it pushes the free fiber end toward the center of the tuft. The fibers will roll inwardly upon themselves under the driving compressive force of the jet stream with a limited degree of multiple roll of the fibers as they are compressed toward the restraining wire 28 into a resiliently compacted nubby head or puff configuration.

As will be appreciated, upon removal of the web material from the forming element, the compressed nubby puff or tuft head will relax and expand slightly, releasing a small amount of the compressed condition resulting from its intorted spiral involution within the confines of the tuft forming aperture. This nubby terminal character of each tuft, taken in conjunction with the pedestal-like root portion that anchors the nubby portion to the main body of the web imparts a springyness or resiliency comparable to the individual loops of a turkish toweling. This, in turn, results in a pliable, yieldable, textured quality desirable in scrubbing and wiping cloths while at the same time imparting the soft feed of an unlooped, high bulk and high loft material. Because the consolidating operation has spirally interwound and entangled the free ends of the fibers within each tuft and fully consolidated the fibers within the tuft head, there is little or no tendency for the fibers to unravel. Thus the tufts retain their desirable cushiony feel and resiliency even in a wet condition. The consolidation also has the beneficial effect of preventing fiber fall-out during use since the compacted tufts are substantially intertangled within the nubby head portion of the tuft. The tufts also exhibit excellent pull-out strength since the fiber ends embedded within the main body portion extend radially outwardly from the tufts in all directions within the plane of the web material and are firmly anchored therein.

If desired, the web may be subjected to additional postformation treatments prior to or after removal from the plate and either prior to or after being dried in a conventional manner. For example, an adhesive may be applied to the tufts only or to the nontufted surface as a liquid or spray while the web is on the plate or subsequent to removal. Additionally, the bonding may take the form of heat for heat activating binding fibers within the web.

Although the many factors mentioned hereinbefore are all interrelated in order to provide the desirable tufted configuration, it has been found that certain generalized guides can be stated. In this regard it has been found that longer fibers not only produce longer initial tufts but also provide added cushioning and added strength within the consolidated tufts. Additionally, it has been found that lower denier fibers give a better tufted product than higher denier fibers regardless of the length of the fibers employed. In this connection and as mentioned hereinbefore, the higher denier fibers generally require a forming element having larger apertures and also require a higher viscosity and lower consistency than corresonding fibers of a finer denier. For example, a 1.5 dpf fiber will provide an acceptable tufted product at a viscosity of 12 cps and a fiber concentration of about 0.2%, whereas comparable results can only be obtained with a 15 dpf fiber at a viscosity of 150 cps and a consistency of 0.1%.

Figure 5:
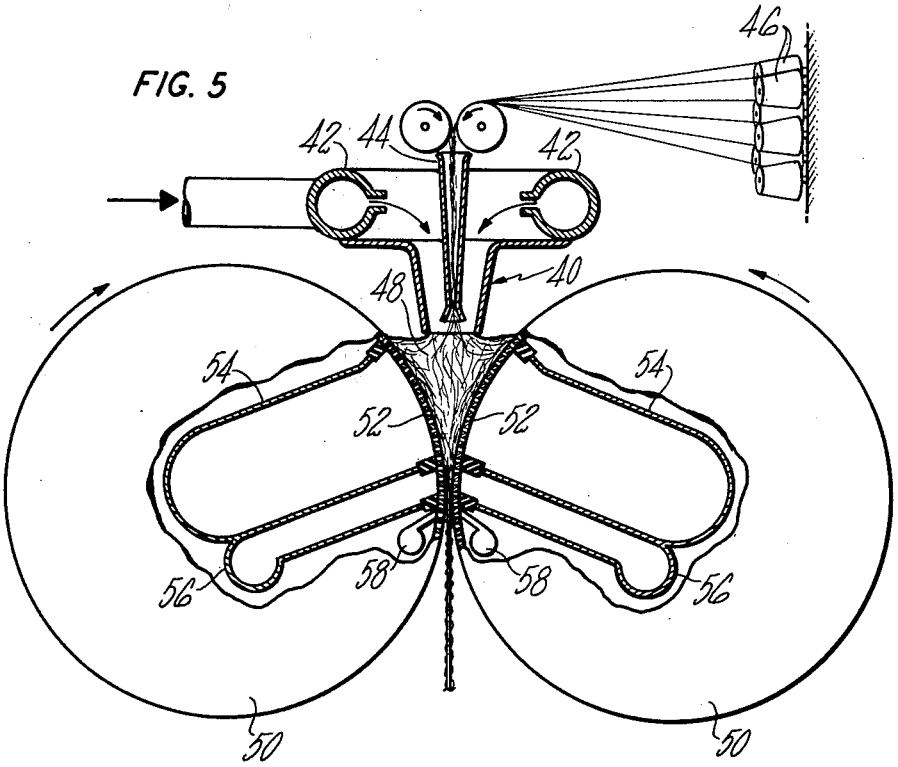
FIG. 5 is a schematic view of a machine incorporating the features of the present invention in producing a two-sided tufted web material.

The use of an apertured plate forming element also facilitates the production of tufted webs having tufts on both sides of the web material as well as other modifications. As shown in FIG. 5, a fiber dispersion may be supplied to a headbox 40 having a dual feed trough 42 and a secondary central feed chute 44 for supplying a scrim insert or a plurality of continuous filaments from an array of bobbins 46. The headbox 40 discharges the fibers and filaments to the nip area 48 between a pair of rotating drums 50 having apertured plate-like confronting surfaces 2 having a thickness of about 0.5 inch. The drums synchronously rotate in opposite directions as indicated by the arrows so that they move in unison through the nip area 48. As shown, a low vacuum suction box 54 can be used in each drum to assist in the fluid dynamics of the system. In this connection good results have been obtained using a low vacuum of about 0.5 inch of mercury. If desired a high vacuum box 56 may also be used in conjunction with the adjustably positionable boxes 54 to assist in removal of the dispersing medium. Also positioned within the interior of each drum adjacent the vacuum box 56 are fluid jet nozzles 58 for effecting consolidation of the tufts prior to being separated from the perforated surfaces of the drums.

In order that the present invention may be more readily understood, it will be further described with reference to the following specific examples which are given by way of illustration only and are not intended to be a limit on the practice of the invention:

EXAMPLE I

Tufted webs were made on a handsheet mold fitted with a perforated web forming plate having a thickness of about 0.5 inch. The plates was a circular disc substantially as depicted in FIGS. 2 and 3 with a flat smooth top surface having a diameter of $3\frac{7}{8}$ inches with a solid periphery defining a perforated area having a diameter of $2\frac{3}{4}$ inches. The apertures within the perforated area were of 0.0625 inch diameter and extended fully through the plate perpendicular to the top surface. The apertures were arranged in staggered rows with each aperture spaced from its six closest adjacent apertures by a distance of 0.09 inch on centers resulting in about 121 apertures per square inch of web forming surface area.

A fiber dispersion was prepared from 1.5 denier per filament (dpf) rayon staple having a length of $\frac{3}{8}$ inch in a 0.04 percent aqueous solution of a polyacrylamide (Separan AP-30) having a viscosity of about 12 cps. Sufficient fibers were added to provide a fiber concentration of 0.05 percent by weight.

Using a vacuum of 1.0 inch of mercury, six webs having a basis weight of about 6.5 ounces/yard$^2$ were formed on the perforated plate from the fiber dispersion. Three of the webs underwent tuft consolidation by a reverse fluid flow treatment while still on the forming plate. Using a 0.023 inch diameter water jet with a pressure of 80 psig yielding a jet velocity of approximately 100 feet per second, water was directed against the underside of the web forming plate. Fifteen passes were made over each aperture and the web was easily removed from the plate and dried. A 1 inch wide strip was cut from each of the six webs and tested for strength on a Scott Tensile Tester, Model X5. The three untreated webs used as control sheets exhibited an average dry tensile strength of 148 grams/inch while the consolidated tufted webs gave an average dry tensile of 323 grams/inch. As can be seen, the consolidation of the tufts results in a substantial improvement in tensile strength of the webs.

EXAMPLE II

The procedure of Example I was repeated except the consolidation of the tufts into ball-like clusters similar to French knots was achieved at a lower pressure, namely 40 psig, using a 0.015 inch fluid jet making 15 passes over each aperture. The 40 psig provided a jet velocity of approximately 50 to 60 feet per second.

As mentioned in our earlier application, tufted nonwoven web material is particularly well suited for use in the manufacture of various "disposable" items. These uses include not only wash cloths, wiping cloths, towels, cosmetic wipes, coverstock for diapers, sanitary napkins and the like, blankets, dish cloths, bandages, dressings and other medical supplies, barber's neck bands, head rests, dust collector felts, dust cloths and mops and wiping cloths of all kinds but also wearing apparel such as disposable bathing suits and jackets, surgical masks, disposable cap and industrial and domestic clothing such as costumes and novelty clothing including interlining for clothing. It is anticipated that the tufted web material may also be advantageously employed for disposable bibs, tray covers, placemats, facial tissue, disposable draperies, carpet backing and semi-durable rugs, wall covering, insulating materials including cryogenic and acoustical insulation, obstetrical sheets, sleeping bag liners, bed pad liners and covers, protective wrapping or as substrates for a coating of a fabric softening composition. The web material might also be employed as a filter material for either air or fluid, such as coffee filters or infusion web materials such as tea bags, and if suitably treated could be used as a coating substrate for various items such as a substrate for synthetic leather or as a substitute for buckram interliners. As will be appreciated, laminated structures could also be formed from the nonwoven web material of the present invention including laminates for reinforced layers of plastic film, laminated or molded papers, light diffusers, lampshades or decorative sliding door paper or the material could be used in cordage, stretchable bags or sacks or for use in the upholstery for home furnishings automobiles. The foregoing list of uses is not intended to be exhaustive but is merely exemplary of the versatility of the material produced in accordance with the present invention.

As will be apparent to persons skilled in the art, various modifications, adaptations and variations of the foregoing specific disclosure can be made without departing from the teachings of the present invention.

We claim:

1. A tufted nonwoven water-laid fibrous web material exhibiting high loft, bulk, softness and absorbency comprised of a planar main body member of randomly arranged water dispersable fibers and a plurality of spaced unlooped fiber tufts integral with the main body member and extending freely from the surface thereof, the fibers within said planar body member exhibiting an orientation that is undisturbed from its as formed water-laid random configuration, said tufts being comprised of a puff-like head portion of consolidated fibers and a stem portion of substantially aligned fibers anchoring the head portion to the main body member, the fibers forming said stem portion having first ends extending into the main body member of the web material and opposite ends free of the main body and extending toward said head portion, the puff-like head portion being comprised of fibers spirally consolidated into a compressively resilient intorted and entangled bundle similar in appearance to a French knot.

2. The web material of claim 1 wherein the tufts are arrayed in a high concentration on one planar surface of the main body member and are substantially free of re-entrant loops, said tufts being comprised entirely of liquid dispersable fibers.

3. The web material of claim 1 wherein the fibers within the web include man-made synthetic fibers of at least about 1.0 dpf and a length of from about ⅛ inch up to about a inch or more.

4. A nonwoven web material of claim 1 wherein the fibers are a mixture of papermaking and textile fibers.

5. The web material of claim 1 having a basis weight of at least 1.0 ounce per square yard.

6. The web material of claim 1 wherein continuous filaments are embedded in the main body member.

7. The web material of claim 1 wherein the tufts extend from both planar surfaces of the planar main body member.

* * * * *

UNITED STATES PATENT OFFICE
CERTIFICATE OF CORRECTION

PATENT NO. : 4,042,453
DATED : August 16, 1977
INVENTOR(S) : Bernard W. Conway and James Moran It is certified that error appears in the above-identified patent and that said Letters Patent are hereby corrected as shown below:

Column 3, line 2, before "anchored" insert --not--.

Column 4, line 25, "somehat" should be --somewhat--;
line 30, "end" should be --tend--;
line 31, after "will" insert --loosely rest on the surface of the web material. Each bundle--;
line 36, "tufs" should be --tufts--.

Column 5, line 21, "is effective" should be --in effective--.

Column 6, line 24, "121" should not be in boldface type;
line 51, "curvative" should be --curvature--.

Column 7, line 50, "100" should not be in boldface type;
lines 62 and 63, "centiposie" should be --centipoise--.

UNITED STATES PATENT AND TRADEMARK OFFICE

CERTIFICATE OF CORRECTION

PATENT NO. : 4,042,453

DATED : August 16, 1977

INVENTOR(S) : Bernard W. Conway and James Moran

It is certified that error appears in the above-identified patent and that said Letters Patent are hereby corrected as shown below:

Column 8, line 42, "along" should be --alone--;
line 51, "to" should be --or--.

Column 11, line 3, "end" should be --ends--;
line 22, "feed" should be --feel--.

Column 12, line 8, "2" should be --52--;
line 30, "plates" should be --plate--;
line 67, "results" should be --resulted--.

Column 13, line 44, after "furnishings" insert --and--.

Column 14, line 36, "A" should be --The--.

Signed and Sealed this

Ninth Day of May 1978

[SEAL]

Attest:

RUTH C. MASON
Attesting Officer

LUTRELLE F. PARKER
Acting Commissioner of Patents and Trademarks